US007176418B2

(12) United States Patent
Gama et al.

(10) Patent No.: US 7,176,418 B2
(45) Date of Patent: Feb. 13, 2007

(54) COOKING STOVE

(75) Inventors: Atsuhito Gama, Nagoya (JP); Shinichiro Hata, Nagoya (JP); Hiroyuki Yamada, Nagoya (JP); Kazuya Hirota, Nagoya (JP)

(73) Assignee: Rinnai Corporation, Nagoya (JP)

( * ) Notice: Subject to any disclaimer, the term of this patent is extended or adjusted under 35 U.S.C. 154(b) by 0 days.

(21) Appl. No.: 11/091,341

(22) Filed: Mar. 29, 2005

(65) Prior Publication Data

US 2005/0236390 A1 Oct. 27, 2005

(30) Foreign Application Priority Data

Mar. 31, 2004 (JP) ..... 2004-102480

(51) Int. Cl.
*H05B 1/02* (2006.01)

(52) U.S. Cl. ..... 219/506; 219/508; 219/412; 219/487; 340/545.4

(58) Field of Classification Search ..... 219/505–509, 219/483–486, 412–414, 494, 497, 506, 720, 219/487, 492; 340/545.4
See application file for complete search history.

(56) References Cited

U.S. PATENT DOCUMENTS 4,149,217 A * 4/1979 Tucker ..... 361/644
4,447,692 A * 5/1984 Mierzwinski ..... 219/720
4,633,067 A * 12/1986 Payne et al. ..... 219/483
4,997,161 A 3/1991 Hutchison et al. ..... 251/129.08
5,097,113 A * 3/1992 Aoyama ..... 219/445.1
5,241,463 A 8/1993 Lee ..... 364/400
5,398,597 A * 3/1995 Jones et al. ..... 99/330

FOREIGN PATENT DOCUMENTS

| | | |
|---|---|---|
| JP | 58-186302 | 12/1983 |
| WO | WO 01/29483 | 4/2001 |
| WO | WO 05/024307 | 3/2005 |

* cited by examiner

*Primary Examiner*—Mark Paschall
(74) *Attorney, Agent, or Firm*—Armstrong, Kratz, Quintos, Hanson & Brooks, LLP.

(57) ABSTRACT

The present invention provides a cooking stove that prevents an instruction from being given using the touch switch owing to a factor different from the user's operation, while hindering the user from having an incongruous or anxious feeling when operating the touch switch. Touch switches 10 to 13 are provided on a glass top plate covering a top surface of a cooking stove main body accommodating a left burner and a right burner; the touch switches 10 to 13 sense an object that contacts with or approaches the top surface of the glass top plate. When any of the touch switches is turned on and then turned off again, heating control 31 executes a pre-assigned process to the touch switch. When the touch switch is turned on, lighting control 32 changes the displays of display sections 14 to 17 to ones corresponding to the state of a burner after the process has been executed before executing a pre-assigned process to the touch switch.

4 Claims, 8 Drawing Sheets

COOKING STOVE

BACKGROUND OF THE INVENTION

1. Field of the Invention

The present invention relates to a cooking stove comprising heating means, and in particular, to a cooking stove comprising an operation section that allows a user to give an instruction on an operation of heating means on a top surface of a top plate.

2. Description of the Related Art

A drop-in type cooking stove is conventionally known in which a cooking stove main body 101 is buried in an opening formed in a counter top of a system kitchen as shown in FIG. 8. Operation knobs 103*a* and 103*b* are provided on a glass top plate 102 to ignite and extinguish gas burners 100*a* and 100*b* and to adjust thermal power; the glass top plate 102 covers a top surface of the cooking stove main body 101 in which gas burners 100*a* and 100*b* are accommodated (see, for example, Japanese Utility Model Laid-Open No. 58-186302 (1983)).

Such a cooking stove eliminates the need to form an opening through which an operation section is viewed, in a front surface of the counter top as in the case in which a cooking stove comprising an operation section in a front surface is installed. The cooking stove can be easily installed in the counter top. Further, the gas burners can be ignited and extinguished and thermal power adjusted using the operation knobs 103*a* and 103*b*, provided on the top plate 102 and which are thus easy to see. Consequently, a user can operate the cooking stove more easily and effectively.

In the cooking stove shown in FIG. 8, the operation knobs 103*a* and 103*b* are arranged so as to project from the top surface of the glass top plate 102. Accordingly, the operation knobs 103*a* and 103*b* may obstruct cooking. Thus, for example, a detecting section of an electrical-capacitance sensor may be provided on a back surface of the glass top plate 102 as means for operating the gas burners 100*a* and 100*b*. On the other hand, a touch switch comprising an operation section may be constructed on a front surface of the glass top plate 102. Further, the top surface of the glass top plate 102 may be made flat.

However, if the touch switch is provided as described above, it may be covered with a cooked material boiling over from a pan placed on trivets 104*a* and 104*b* or an object falling onto the glass top plate 102. Then, the touch switch may be turned on. Thus, the cooking stove is designed so that when turned on and then off again, the touch switch accepts an operation performed on itself. Then, when kept on because of the cooked material boiled over, the touch switch does not accept an operation performed on itself.

However, if the cooking stove is designed so that when turned on and then off again, the touch switch accepts an operation performed on itself, then even when the user touches the touch switch to attempt to ignite the burner, the burner is not ignited until the user takes his or her fingers off the touch switch and the touch switch is then turned off. In this case, when the user does not immediately takes his or her fingers off the touch switch, an igniting operation is not performed in spite of the ignition instruction. This may strike the user as incongruous or the user may feel anxious.

The present invention is made in view of these circumstances. It is an object of the present invention to provide a cooking stove that prevents an instruction from being given using the touch switch owing to a factor different from the user's operation, while hindering the user from having an incongruous or anxious feeling when operating the touch switch.

SUMMARY OF THE INVENTION

To accomplish the above object, the present invention relates to improvements in a cooking stove comprising a touch switch provided on a top plate covering a top surface of a cooking stove main body accommodating heating means, to allow a user to give an instruction on activation of the heating means, the touch switch sensing an object that contacts or approaches the top surface of the top plate, and heating control means for determining whether the touch switch is in a sensing state or a non-sensing state to perform a predetermined operation pre-assigned to the touch switch, on the heating means in accordance with a result of the determination.

The cooking stove is characterized by comprising state display means for displaying a state of the heating means, and display control means for, when the touch switch shifts from the non-sensing state to the sensing state, changing display contents of the state display means to display corresponding to a state of the heating means after the predetermined operation has been performed, and the heating control means performs the predetermined operation on the heating means when the touch switches shifts from the non-sensing state to the sensing state and then returns to the non-sensing state.

According to the present invention, after the touch switch has shifted from the non-sensing state to the sensing state, when it does not return to the non-sensing state, the heating control means does not perform the predetermined operation on the heating means. This prevents the predetermined operation from being performed on the heating means when the touch switch is kept in the sensing state after having shifted from the non-sensing state to the sensing state owing to a factor different from the user's operation such as a boiling-over cooked material.

On the other hand, when the touch switch shifts from the non-sensing state to the sensing state, the display control means changes the display contents of the state display means to a display corresponding to the state of the heating means on which the predetermined operation has been performed. Thus, the user can visually confirm that the instruction based on an operation of the touch switch has been accepted. Thus, the user feels less conscious of the delay time after the touch switch has switched from the non-sensing state to the sensing state and before the touch switch returns to the non-sensing state to allow the predetermined operation to be actually performed on the heating means. This hinders the user from having an incongruous or anxious feeling about the delay time.

Further, the present invention is characterized in that after the touch switch has shifted from the non-sensing state to the sensing state, when touch switch does not return to the non-sensing state within a predetermined time, the display control means stops the display corresponding to the state of the heating means after the predetermined operation has been performed.

According to the present invention, after the touch switch has shifted from the non-sensing state to the sensing state, when it does not return to the non-sensing state within the predetermined time, the display control means stops the display corresponding to the state of the heating means observed after the predetermined operation has been performed. After the touch switch has shifted from the non-sensing state to the sensing state owing to a boiling-over cooked material or the like, the sensing state is maintained. Then, the actual state of the heating means remains different from the state of the heating means displayed on the state display means. This hinders the user, who confirmed the state display means, from having an incongruous feeling.

Furthermore, the present invention is characterized by comprising error informing means, and in that after the touch switch has shifted from the non-sensing state to the sensing state, when touch switch does not return to the non-sensing state within a predetermined time, the display control means causes the error informing means to report this error.

According to the present invention, after the touch switch has shifted from the non-sensing state to the sensing state, if the sensing state is maintained even after the predetermined time has passed, it can be assumed that the touch switch is covered with a boiling-over cooked material, a fallen object, a cooking container, or the like. Thus, in this case, the error informing means reports an error to urge the user to deal with the above situation.

DETAILED DESCRIPTION OF THE PREFERRED EMBODIMENT

Figure 2:
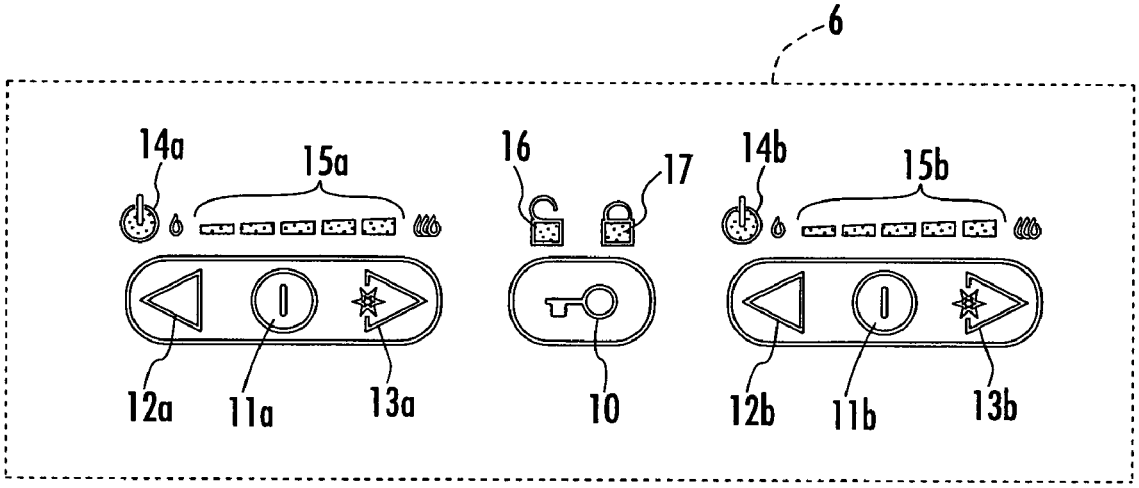
FIG. 2 is a detailed diagram of an operation section shown in FIG. 1.
Figure 3:
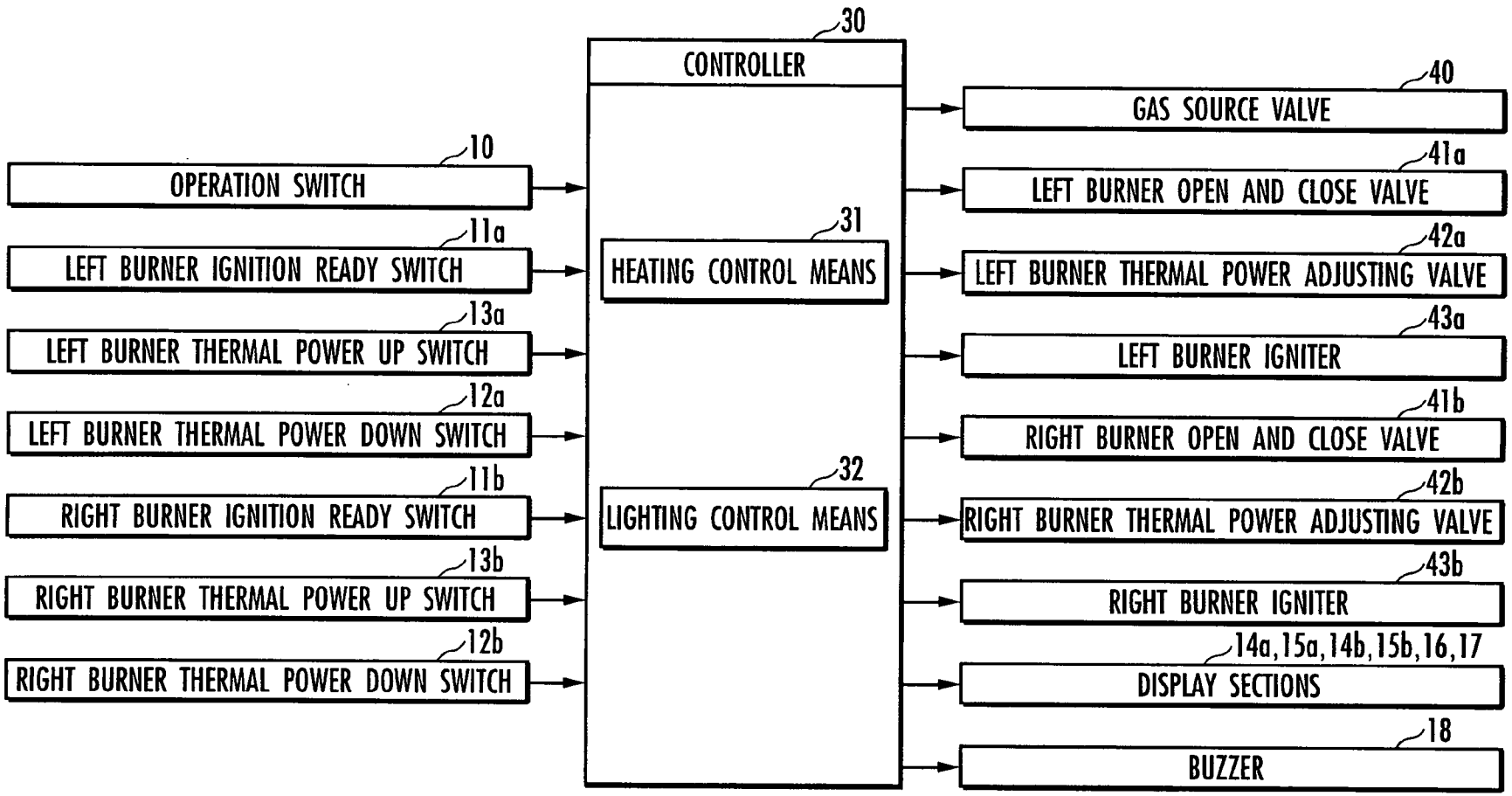
FIG. 3 is a control block diagram of the cooking stove.
Figure 4:
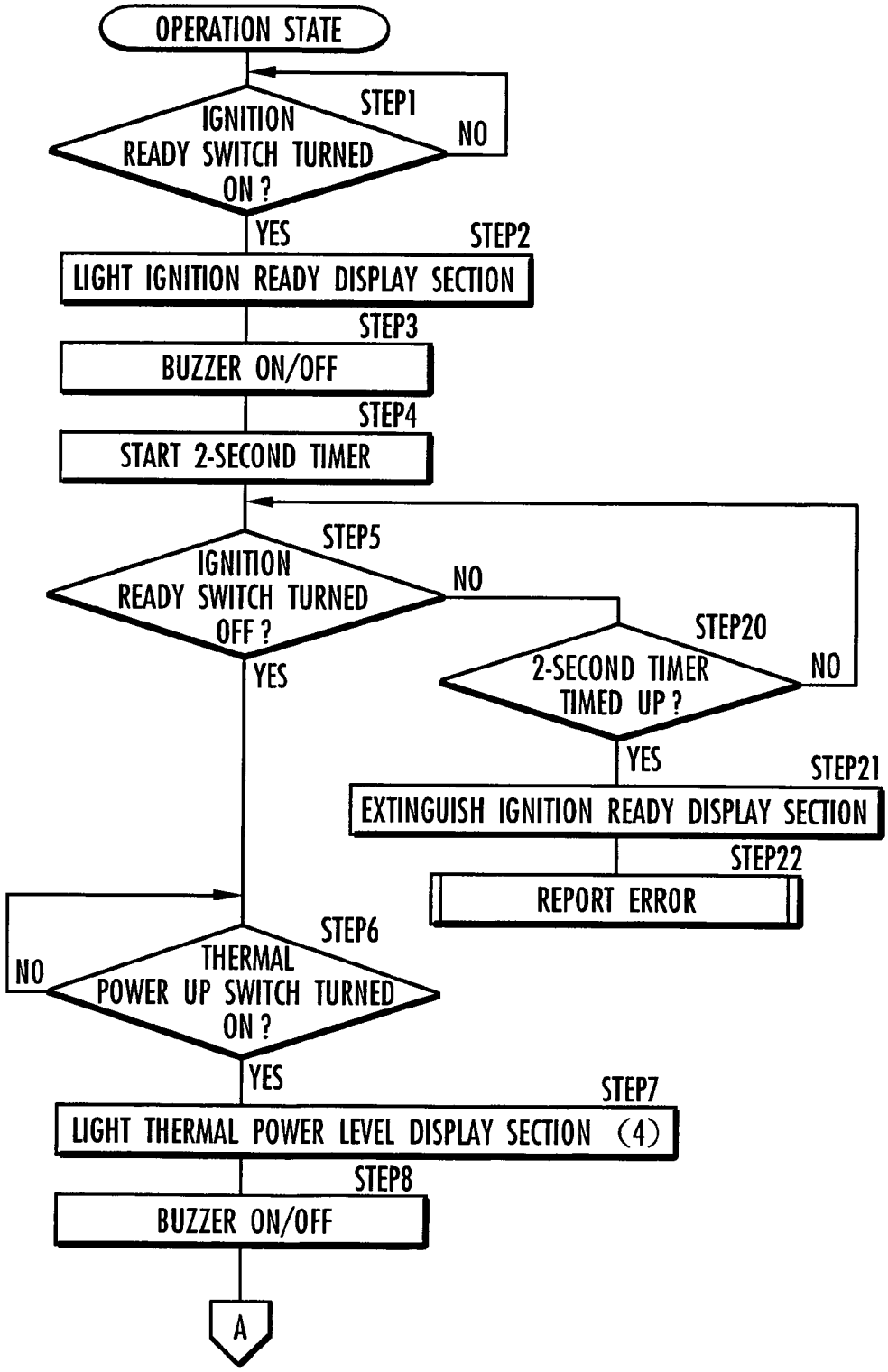
FIG. 4 is a flowchart of a process of igniting a burner.
Figure 5:
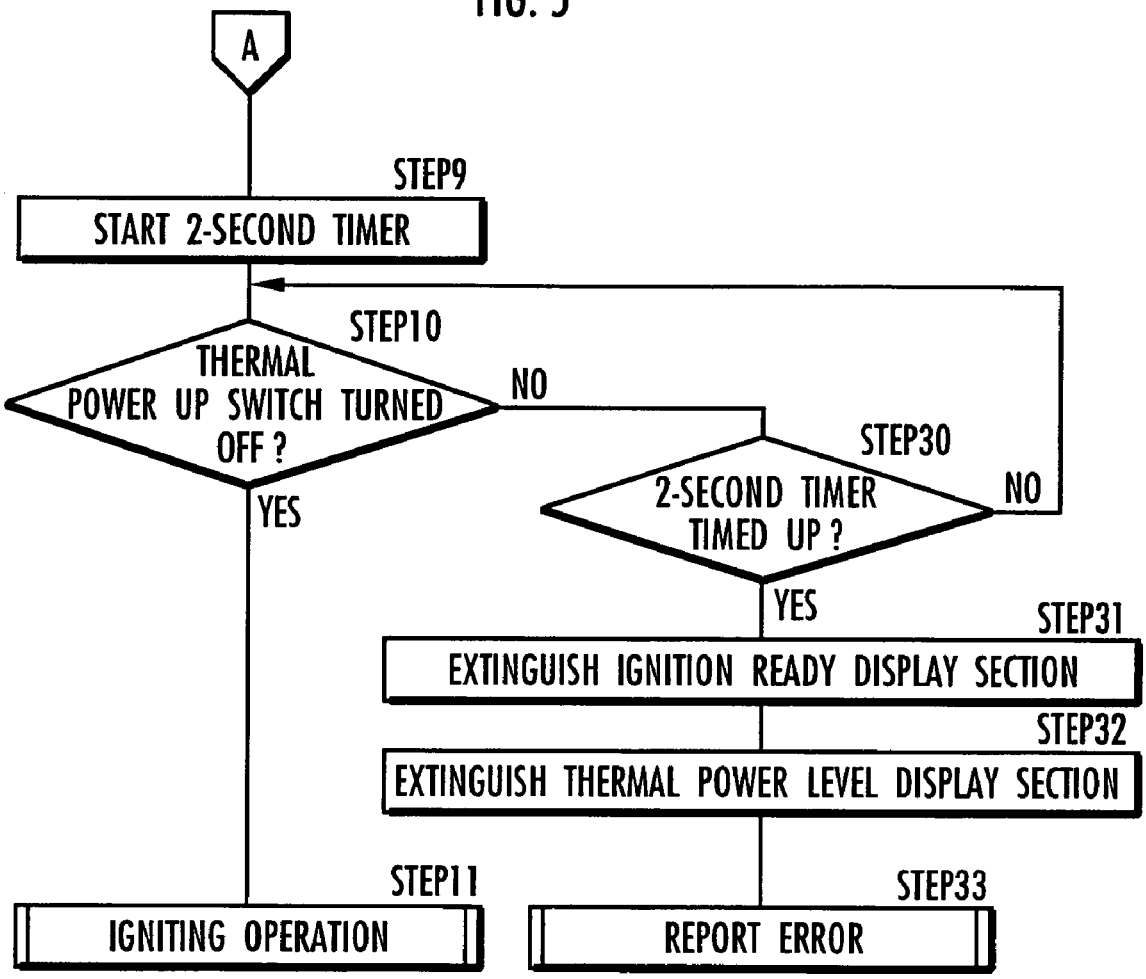
FIG. 5 is a flowchart of a process of igniting a burner.
Figure 6:
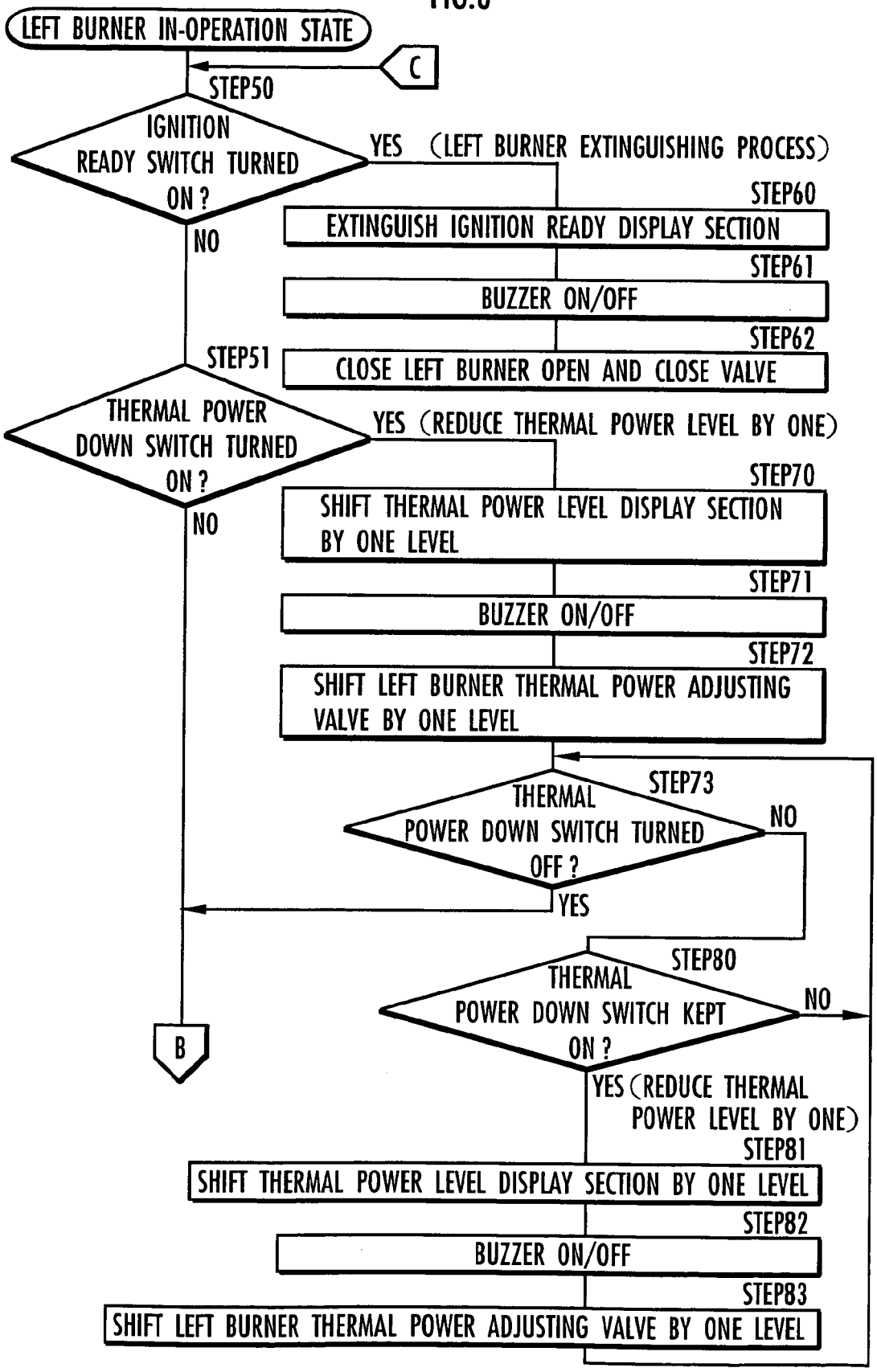
FIG. 6 is a flowchart of various processes executed while the burner is in operation.
Figure 7:
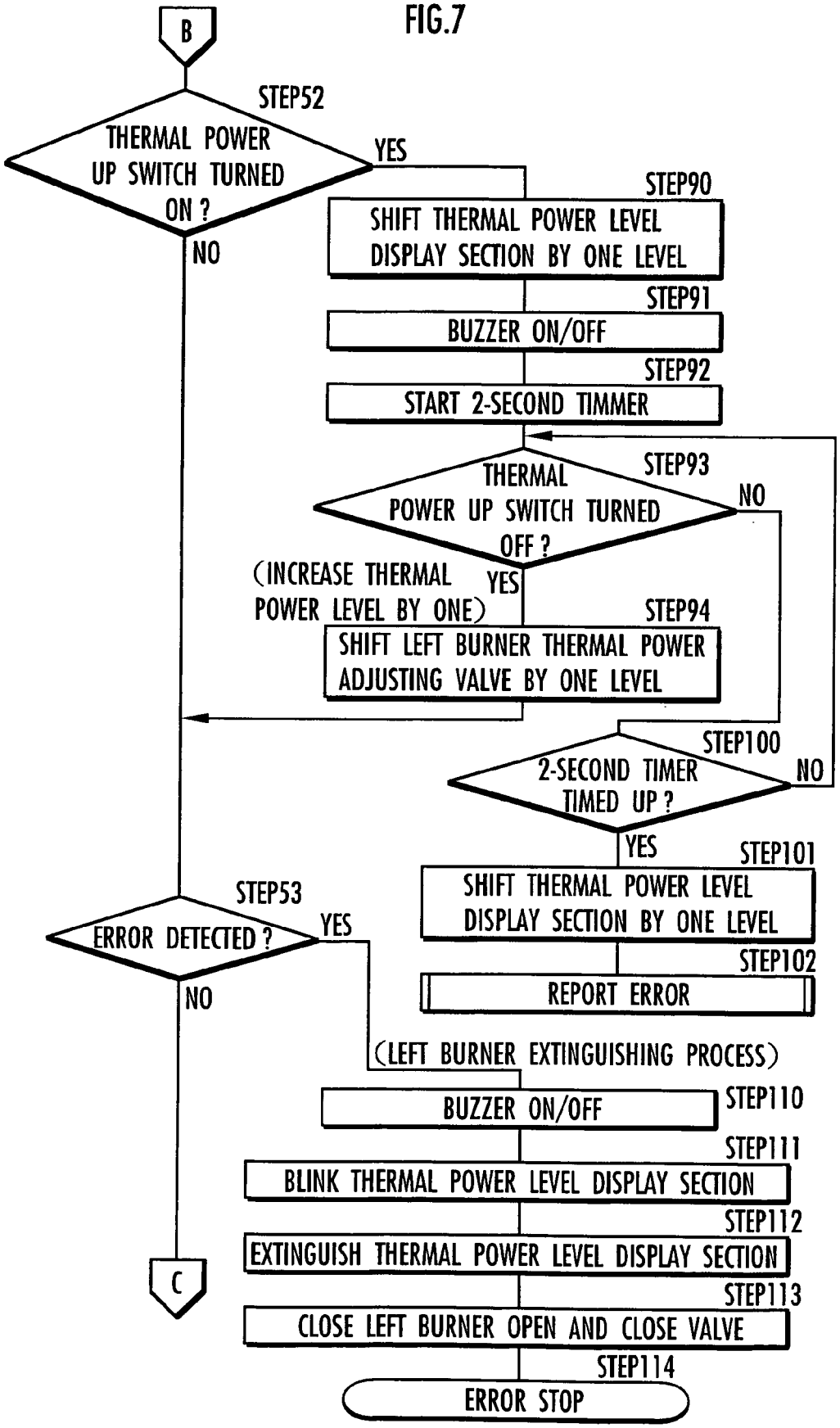
FIG. 7 is a flowchart of the various processes executed while the burner is in operation.
Figure 8:
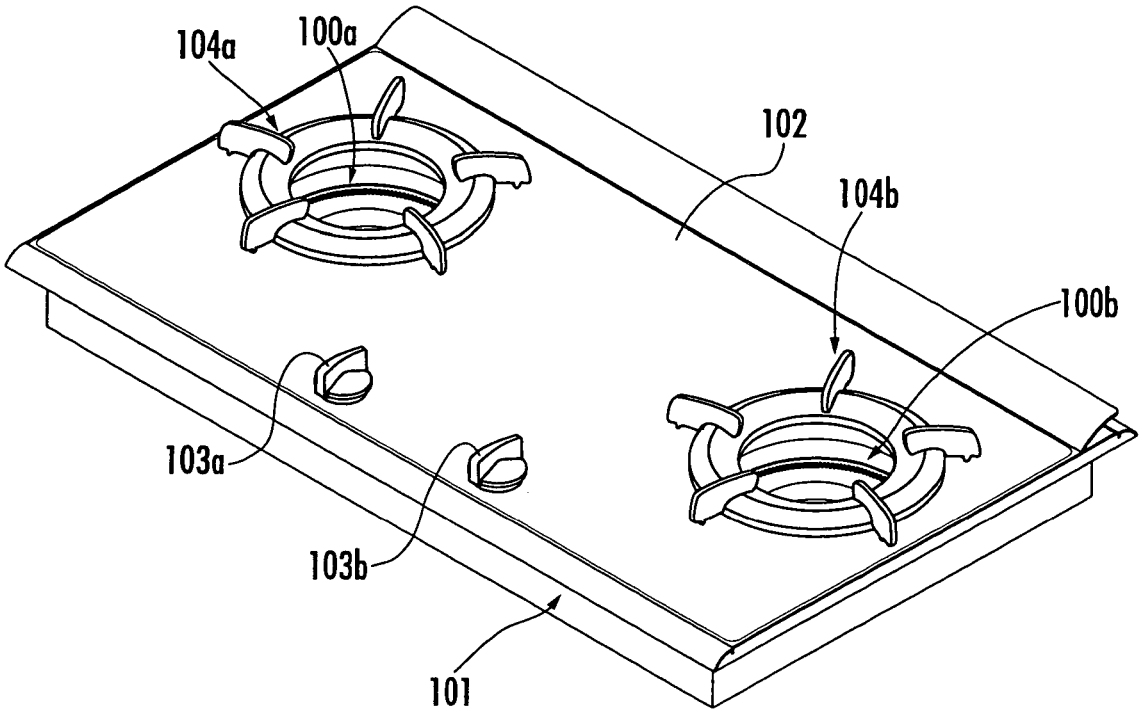
FIG. 8 is a diagram of the appearance of a conventional cooking stove.

An embodiment of the present invention will be described with reference to FIGS. 1 to 7. FIG. 1 is a diagram showing the appearance of a cooking stove according to the present invention. FIG. 2 is a detailed diagram of an operation section shown in FIG. 1. FIG. 3 is a control block diagram of the cooking stove. FIGS. 4 and 5 are flowcharts of a process of turning on a burner. FIGS. 6 and 7 are flowcharts of various processes executed while the burner is in operation.

Figure 1A:
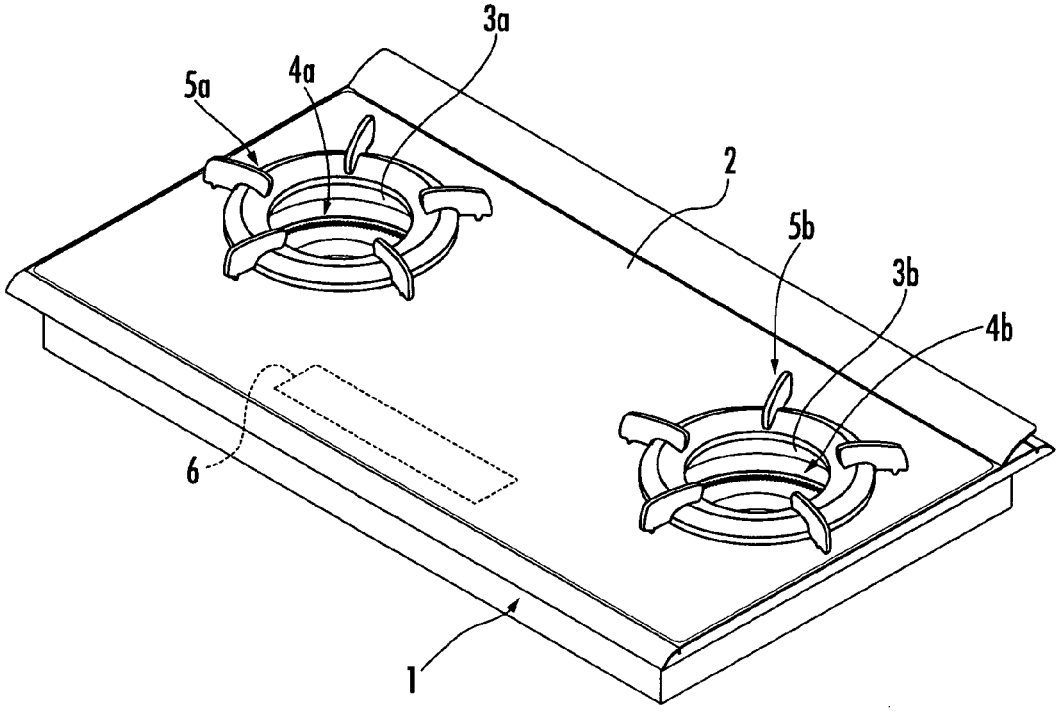
FIG. 1 is a diagram showing the appearance of a cooking stove according to the present invention.
Figure 1B:
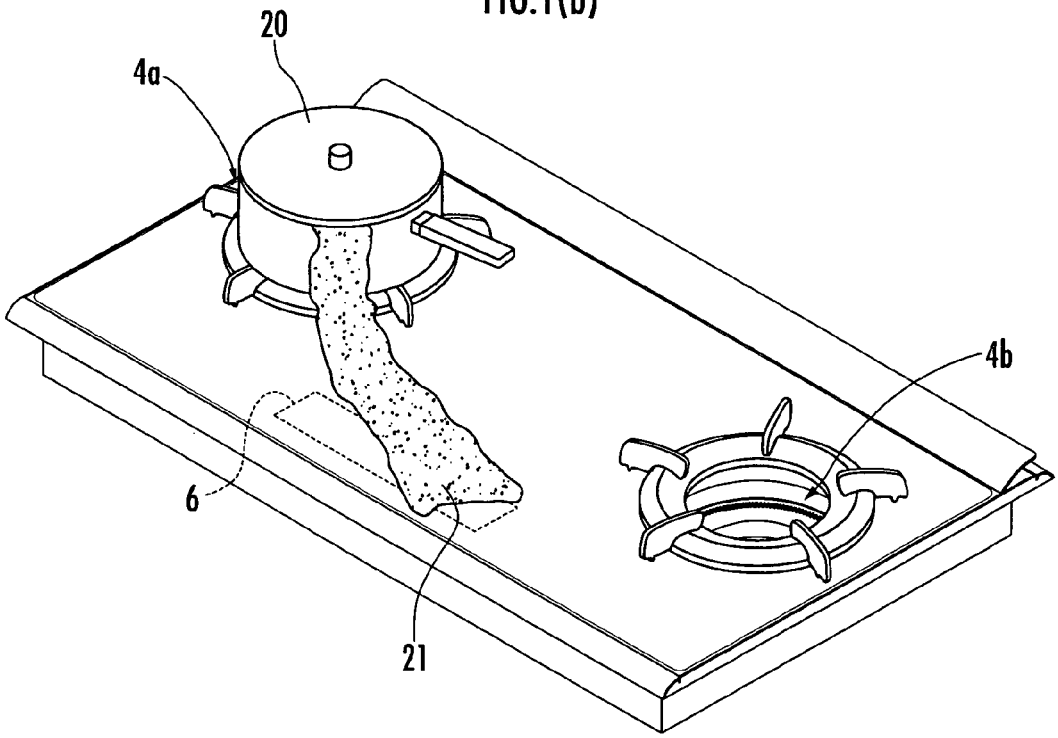

FIG. 1 shows a drop-in type cooking stove in which a glass top plate 2 formed of crystallized glass, which has an excellent heat resistance, is installed on a top surface of a cooking stove main body 1. With reference to FIG. 1A, a lateral pair of cooking stove openings 3*a* and 3*b* is formed in the glass top plate 2. A left burner 4*a* and a right burner 4*b* (corresponding to heating means according to the present invention) are provided in the cooking stove main body 1 so as to be viewed through the cooking stove openings 3*a* and 3*b*. Further, trivets 5*a* and 5*b* are arranged in the cooking stove openings 3*a* and 3*b*; cooking containers are placed on the trivets 5*a* and 5*b*. An operation section 6 is provided in the front of a top surface of the glass top plate 2 to give an instruction for activating the left burner 4*a* and the right burner 4*b*.

With reference to FIG. 2, the operation section 6 comprises an operation switch 10 that switches between an "operation state" in which the left burner 4*a* and the right burner 4*b* can be instructed on actuation while the cooking stove remains powered on and a "standby state" in which the burners cannot be instructed on actuation. Further, to instruct the left burner 4*a* on actuation, the operation section 6 is provided with an ignition ready switch 11*a* that allows the left burner 4*a* to get ready for ignition, a thermal power down switch 12*a* and a thermal power up switch 13*a* which switch the thermal power of the left burner 4*a* among five levels (levels 1 to 5), an ignition ready display section 14*a* (corresponding to state display means according to the present invention) that is lighted while the left burner 4*a* is ready for ignition or is in operation, and thermal power level display section 15*a* (corresponding to state display means according to the present invention) that displays a setting for the thermal power of the left burner 4*a*.

While the left burner 4*a* is ready for ignition, when the thermal power up switch 13*a* is operated, the left burner 4*a* is ignited. On the other hand, while the left burner 4*a* is in operation, when the ignition ready switch 11*a* or the operation switch 10 is operated, the left burner 4*a* is turned off.

Similarly, to instruct the left burner 4*b* on actuation, the operation section 6 is provided with an ignition ready switch 11*b* that allows the right burner 4*b* to get ready for ignition, a thermal power down switch 12*b* and a thermal power up switch 13*b* which switch the thermal power of the right burner 4*b* among five levels (levels 1 to 5), an ignition ready display section 14*b* (corresponding to state display means according to the present invention) that is lighted while the right burner 4*b* is ready for ignition or is in operation, and thermal power level display section 15*b* (corresponding to state display means according to the present invention) that displays a setting for the thermal power of the right burner 4*b*.

While the right burner 4*b* is ready for ignition, when the thermal power up switch 13*b* is operated, the right burner 4*b* is ignited. On the other hand, while the right burner 4*b* is in operation, when the ignition ready switch 11*b* or the operation switch 10 is operated, the right burner 4*b* is turned off.

Moreover, the operation section 6 comprises an unlock display section 16 that is lighted in the "operation state" and a lock display section 17 that is lighted when the operations of all the switches are disabled, that is, the appliance is brought into a child lock state, after the operation switch 10 has been continuously operated for more than a predetermined time (for example 4 seconds).

Each of the switches of the operation section 6 is a non-contact type touch switch composed of an electrical-capacitance sensor provided on a back surface of the glass top plate 2 and a print portion printed on a part of the front surface of the glass top plate 2 which is opposite the electrical-capacitance sensor, the print portion showing a touch point of the switch. When an electrostatic object is placed on the print portion (part of the front surface of the glass top plate 2 which is opposite the electrical-capacitance sensor), the electrical-capacitance sensor detects the electrostatic object to turn on the touch switch (this corresponds to a sensing state according to the present invention). When the electrostatic object is not placed on the print portion, the electrical-capacitance sensor does not detect the electrostatic object, the touch switch remains off (this corresponds to a non-sensing state according to the present invention).

Further, each of the display sections of the operation section 6 is composed of a LED provided on the back surface of the glass top plate 2 and a print portion printed on a part of the front surface of the glass top plate 2 which is opposite the LED. When the LED is turned on, the display section is lighted. When the LED is turned off, the display section is extinguished.

The thermal power level display section 15*a* indicates the thermal power level (levels 1 to 5) of the left burner 4*a* using the number of lighting portions lighted, the lighting portions being provided in a bar display consisting of five lighting portions; the lighting starts with the leftmost lighting portion and the number of lighting portions lighted increments as the thermal power increases. For example, when the thermal power level of the left burner 4*a* is 1, the only the leftmost lighting portion of the bar display is lighted. When the thermal power level of the left burner 4*a* is 5, the five lighting portions of the bar display are all lighted. Similarly, the thermal power level display section 15*b* indicates the thermal power level (levels 1 to 5) of the right burner 4*b* using the number of lighting portions lighted, the lighting portion being provided in a bar display consisting of five lighting portions; the lighting starts with the leftmost lighting portion and the number of lighting portions lighted increments as the thermal power increases.

Now, with reference to FIG. 3, the cooking stove main body 1 internally comprises a controller 30 that controls the general actuation of the cooking stove. A sensing signal for the operational state of each of the switches (operation switch 10, ignition ready switches 11*a* and 11*b*, thermal power down switches 12*a* and 12*b*, and thermal power up switches 13*a* and 13*b* ) of the operation section 6 is input to the controller 30.

Control signals output by the controller 30 controls the actuation of a gas source valve 40 that switches between the supply of fuel gas to the cooking stove main body 1 and the blockage of the supply, a left burner open and close valve 41*a* that switches between the supply of fuel gas to the left burner 4*a* and the blockage of the supply, a left burner thermal power adjusting valve 42*a* that varies the flow rate of fuel gas supplied to the left burner 4*a*, a left burner igniter 43*a* that applies a high voltage to an ignition electrode (not shown) of the left burner 4*a* to cause spark discharge, a right burner open and close valve 41*b* that switches between the supply of fuel gas to the right burner 4*b* and the blockage of the supply, a right burner thermal power adjusting valve 42*b* that varies the flow rate of fuel gas supplied to the right burner 4*b*, and a right burner igniter 43*b* that applies a high voltage to an ignition electrode (not shown) of the right burner 4*b* to cause spark discharge.

Moreover, control signals output by the controller 30 control lighting/extinction of the display sections provided in the operation section 6 (ignition ready display sections 14*a* and 14*b*, thermal power level display sections 15*a* and 15*b*, unlock display section 16, and lock display section 17) and turn-on and off of a buzzer 18.

The controller 30 also comprises heating control means 31 for controlling the actuation of the left burner 4*a* and right burner 4*b*, and lighting control means 32 for controlling the lighting/extinction of the display sections provided in the operation section 6 and reporting by the buzzer 18.

As described above, the touch switches provided in the operation section 6 sense whether or not an electrostatic object is present on the top surface of the glass top plate 2. Thus, even though the user does not touch any touch switches with his or her finger, any of the touch switches may be turned on as follows. While the user is using only the left burner 4*a* to heat a cooked material in a pan 20, as shown in FIG. 1(*b*) the cooked material may boil over from the pan and the boiling-over cooked material 21 reaches the operation section 6 to turn on any of the touch switches for the right burner 4*b*. Any of the touch switches may also be turned on when the operation section 6 is covered with an object having fallen onto the glass top plate 2 (a cloth or cooked material) or a cooking container placed on the glass top plate 2.

Thus, the heating control means 31 provided in the controller 30 executes a process required to prevent an operational instruction for the left burner 4*a* or right burner 4*b* to be mistakenly accepted when any of the touch switches is turned on because of a factor different from the user's operation. Further, the lighting control means 32 provided in the controller 30 executes a process required to inhibit the user operating the touch switch from having an incongruous or anxious feeling in connection with the process of the heating control means 31.

Now, these processes will be described in accordance with a flowchart shown in FIGS. 4 to 7. The flowchart in FIGS. 4 to 7 shows processes for the left burner 4*a*, but similar processes are executed on the right burner 4*b*.

First, FIGS. 4 and 5 show a process for an operation of igniting the left burner 4*a*. When the operation switch 10 is operated to switch from the "standby state" to the "operation state" (the unlock display section 16 is then lighted), the heating control means 31 waits for the ignition ready switch 11*a* to be turned on in STEP 1 in FIG. 4.

Then, when the ignition ready switch 11*a* is turned on, the process shifts from STEP 1 to STEP 2. STEPS 2 and 3 are executed by the lighting control means 32. The lighting control means 32 lights the ignition ready display section 14*a* in STEP 2. The lighting control means 32 activates the buzzer 18 in STEP 3. The "ignition ready state", in which the thermal power up switch 13*a* can be actually used to instruct the left burner 4*a* to be ignited, is established after the ignition ready switch 11*a* is turned off again in STEP4.

However, if the ignition ready display section 14*a* is lighted after the ignition ready switch 11*a* has been turned off again, no reaction occurs until the ignition ready switch 11*a* is turned off again even though the user has touched the ignition ready switch 11*a* to given an instruction for shifting to the "ignition ready state". This may cause the user to have an incongruous or anxious feeling.

Thus, the lighting control means 32 lights the ignition ready display section 14*a* before the "ignition ready state" is actually established. This notices the user that an operation of the ignition ready switch 11*a* has been accepted. The user is thus inhibited from having an incongruous or anxious feeling.

In STEP4, the heating control means 31 starts a 2-second time (2 seconds correspond to a predetermined time according to the present invention). Then, in STEP5, the heating control means 31 waits for the ignition ready switch 11*a* to be turned off again while using a loop consisting of STEP5 and STEP20 to check whether or not the 2-second timer has timed up in STEP20. When the 2-second timer has timed up in STEP20, the process advances to STEP21.

In STEP21, the lighting control means 32 extinguishes the ignition ready display means 14*a*. Then, in STEP22, the lighting control means 32 blinks the ignition ready display section 14*a* and activates the buzzer 18 to carry out "error informing". This prevents the "ignition ready state" from being established owing to a factor different from the user's operation. Further, the user is noticed that there is an error such as boiling-over of a cooked material. In this case, the buzzer 18 and the ignition ready display section 14*a* correspond to error informing means according to the present invention. Alternatively, the "error informing" may be carried out by either activating the buzzer 18 or blinking the ignition ready display section 14*a*.

On the other hand, when the ignition ready switch 11*a* is turned off again in STEP5 before the 2-second timer times up in STEP20, the lighting control means 32 can determine that the user has operated the ignition ready switch 11*a*. Thus, in this case, the process shifts to the "ignition ready state" and waits for the thermal power up switch 6 to be turned on in STEP6. In this case, the operation of establishing the "ignition ready state" corresponds to a predetermined operation pre-assigned to the ignition ready switch 11*a*.

When the thermal power switch 6 is turned on, the process advances to STEP7. STEP 7 and STEP8 are processing executed by the lighting control means 32. In STEP7, the lighting control means 32 lights the thermal power display means 15*a* at a level 4. In STEP8, the lighting control means 32 activates the buzzer.

The thermal power level 4 corresponds to a gas quantity setting for a process of igniting the left burner 4. The left burner 4*a* is actually ignited after the turn-off of the thermal power up switch 13*a* in STEP10, followed by the advancement of the process to STEP11. In this manner, the thermal power level display section 15*a* displays a thermal power level used upon ignition before an actual operation of igniting the left burner 4*a*. This inhibits the user from having an incongruous or anxious feeling about switch operations as in the case of STEP2 and STEP3.

In STEP9 in FIG. 5, the heating control means 31 starts the 2-second timer. Then, in STEP10, the heating control means 31 waits for the thermal power up switch 13*a* to be turned off again while using a loop consisting of STEP10 and STEP30 to check whether or not the 2-second timer has timed up in STEP30.

Then, when the thermal power up switch 13*a* is turned off again in STEP10, that is, the thermal power up switch 13*a* is turned on in STEP 6 and then turned off again within 2 seconds, the heating control section 31 can determine that the user has operated the thermal power up switch 13*a*. Thus, in this case, the process advances to STEP11, and the heating control means 31 ignites the left burner 4*a*. Specifically, after actuating the igniter 43*a* to cause spark discharge in the ignition electrode, the heating control means 31 opens the gas source valve 40 and the left burner open and close valve 41*a*. The heating control means 31 then sets the left burner thermal power adjusting valve 42*a* at the thermal power level 4 to ignite the left burner 4*a*. In this case, the series of operations for igniting the left burner 4*a* correspond to a predetermined operation pre-assigned to the thermal power up switch 13*a* according to the present invention.

When the 2-second timer times up in STEP30, the process advances to STEP31. In STEP31, the lighting control means 32 extinguishes the ignition ready display section 14*a*. Then, the lighting control means 32 turns off (extinguishes) the thermal power level display section 15*a* in STEP32 and carries out "error informing" in STEP33. This prohibits an igniting operation when the thermal power up switch 13*a* is kept on owing to a factor such as a boiling-over cooked material.

FIGS. 6 and 7 show processing executed when the touch switch is turned on while the left burner 4*a* is in operation. When the ignition ready switch 11*a* is turned on in STEP50, the process branches to STEP60. The lighting control means 32 then extinguishes the ignition ready display section 14*a*. In STEP61, the lighting control means 32 activates the buzzer 18. Then, in STEP62, the heating control means 31 immediately closes the left burner open and close valve 41*a* to extinguish the left burner 4*a*. In this case, the operation of extinguishing the left burner 4*a* corresponds to a predetermined operation pre-assigned to the ignition ready switch 11*a* according to the present invention.

In this manner, when the ignition ready switch 11*a* is turned on while the left burner 4*a* is in operation, the left burner 4*a* is extinguished before the ignition ready switch 11*a* is turned off again. This conveniently allows the left burner 4*a* to be extinguished immediately when the user operates the ignition ready switch 11*a* in order to end cooking.

Further, when the thermal power down switch 12*a* is operated in STEP51, the process advances to STEP70. Then, in STEP70, the lighting control means 32 reduces the number of lighting portions in the thermal power level display section 15*a* by one. In STEP71, the lighting control means 32 activates the buzzer. Further, in STEP72, the heating control means 31 reduces the opening degree of the left burner thermal power adjusting valve 42*a* by one. This in turn reduces the thermal power level of the left burner 4*a* by one. In this case, the operation of reducing the thermal power of the left burner 4*a* corresponds to a predetermined operation pre-assigned to the thermal power down switch 12*a* according to the present invention.

In this manner, when the thermal power down switch 12*a* is turned on while the left burner 4*a* is in operation, the thermal power level of the left burner 4*a* is reduced by one before the thermal power down switch 12*a* is turned of f again. When the thermal power down switch 12*a* is brought into a "continuous on state" in which it is kept on for a predetermined time (for example, 1 second) using a loop consisting of STEP73 and STEP80, the process advances to STEP81. STEP81 to STEP83 are similar to STEP70 to STEP72 described above, and the thermal power level of the left burner 4*a* decreases by one.

Then, the process returns from STEP83 to STEP73. When the thermal power down switch 12*a* is in the "continuous on state", the process advances from STEP80 to STEP81 to repeat the processing from STEP81 to STEP83. Thus, if for example, a cooked material boils over, the user can continuously and quickly reduce the thermal power of the left burner 4*a* to the minimum level (level 1) by keeping touching the thermal power down switch 12*a* to keep it on.

Further, in STEP52 in FIG. 7, when the thermal power up switch 13*a* is turned on, the process branches to STEP90. Then, in STEP90, the lighting control means 32 increases the number of lighting portions in the thermal power level display section 15*a* which are lighted by one. In STEP91, the lighting control means 32 activates the buzzer to notice the user of the increase in the thermal power of the left burner 4*a*.

In this case, the process of increasing the thermal power of the left burner 4*a* is executed in STEP94, described later. However, by reporting an increase in thermal power when the thermal power up switch 13*a* is turned on and before actual processing, it is possible to allow the user to realize that the operation of increasing the thermal power has been accepted. Thus, by delaying actual processing executed in response to an operation of the touch switch, it is possible to inhibit the user from having an incongruous feeling.

Subsequently, in STEP92, the heating control means 31 starts the 2-second timer. The heating control means 31 waits for the thermal power up switch 13*a* to be turned off again in STEP93 while using a loop consisting of STEP93 and STEP100 to check whether or not the 2-second timer has timed up in STEP100. In STEP93, when the thermal power up switch 13*a* is turned off, the process advances to STEP94. The heating control means 31 then increases the opening degree of the left burner thermal power adjusting valve 42*a* by one. This in turn increases the thermal power level of the left burner 4*a* by one. In this case, the operation of increasing the thermal power of the left burner 4*a* corresponds to a predetermined operation pre-assigned to the thermal power up switch 13*a* according to the present invention.

On the other hand, when the 2-second timer times up in STEP100, the process advances to STEP101. The lighting control means 32 then reduces the number of lighting portions in the thermal power level display section 15*a* which are lighted by one. The lighting control means 32 then returns the display of the thermal power level display section 15*a* to the previous one corresponding to the actual state of the left burner 4*a*. In this case, the process of increasing the thermal power of the left burner 4*a* is not executed.

Thus, when a boiling-over cooked material or the like causes the thermal power up switch 13*a* to be kept on, it is possible to prevent an increase in the thermal power of the left burner 4*a*. Further, the lighting control means 32 stops the display of the thermal power level display section 15*a* corresponding to the increase in thermal power and provides the previous one corresponding to the actual thermal power of the left burner 4*a*. Consequently, upon checking the thermal power level display section 15*a*, the user does not have an incongruous feeling.

Further, in STEP53, when an error such as an accidental fire in the left burner 4*a* is detected, the process branches to STEP110. In STEP110, the lighting control means 32 then activates the buzzer. Then, in STEP111, the lighting control means 32 blinks the ignition ready display section 14*a* to notice the user of the error. Then, in STEP112, the lighting control means 32 extinguishes the thermal level display section 15*a*. Subsequently, in STEP113, the heating control means 31 closes the left burner open and close valve 41*a* to block the supply of fuel gas to the left burner 4*a*. This causes the left burner 4*a* to be extinguished. The process then advances to STEP114 to enter an error stop state.

In the present embodiment, the cooking stove comprising the gas burners 4*a* and 4*b* is shown as heating means according to the present invention. However, the present invention is applicable to a cooking stove comprising another type of heating means such as an electric heater.

Further, in the present embodiment, the cooking stove is shown which employs the electrical-capacitance touch switches as touch switches according to the present invention. However, the type of the touch switches is not limited to this. The present invention is applicable to a cooking stove employing photo switches comprising an infrared light emitting section/light receiving section or mechanical contact type touch switches such as tact switches.

Furthermore, in the present embodiment, the cooking stove is shown which comprises the glass top plate 2 composed of heat resistant glass, as a top plate according to the present invention. However, the present invention is applicable to a cooking stove comprising a top plate of a different material such as stainless steel.

Moreover, in the present embodiment, when the 2-second timer times up in STEP20 in FIG. 4, the ignition ready display section is extinguished in STEP21 and an error is reported in STEP22. However, the effects of the present invention can be produced whether only one of STEP21 and STEP22 is executed or neither of them is executed.

Similarly, when the 2-second timer times up in STEP30, the effects of the present invention can be produced whether only one of the extinction of the display section in STEP31 and STEP32 and the "error informing" in STEP33 is executed or neither of them is executed. Further, when the 2-second timer times up in STEP100, the effects of the present invention can be produced whether only one of the returning of the display of the thermal power level display section 15*a* to the previous one in STEP101 and the "error informing" in STEP102 is executed or neither of them is executed.

Moreover, when the operation switch 10 is turned on and then turned off again, the "standby state" may be switched to the "operation state". In this case, when the operation switch 10 is turned on, the lock display section 17 may be lighted.

What is claimed is:

1. A cooking stove comprising:

a touch switch provided on a top plate covering a top surface of a cooking stove main body accommodating heating means, to allow a user to give an instruction on activation of the heating means, the touch switch sensing an object that contacts or approaches the top surface of the top plate; and heating control means for determining whether the touch switch is in a sensing state or a non-sensing state to perform a predetermined operation pre-assigned to the touch switch, on the heating means in accordance with a result of the determination, wherein the cooking stove comprises:

state display means for displaying a state of the heating means; and display control means for, when the touch switch shifts from the non-sensing state to the sensing state, changing display contents of the state display means to display corresponding to a state of the heating means after the predetermined operation has been performed, and the heating control means performs the predetermined operation on the heating means when the touch switches shifts from the non-sensing state to the sensing state and then returns to the non-sensing state.

2. The cooking stove according to claim 1, wherein after the touch switch has shifted from the non-sensing state to the sensing state, when touch switch does not return to the non-sensing state within a predetermined time, the display control means stops the display corresponding to the state of the heating means after the predetermined operation has been performed.

3. The cooking stove according to claim 1, comprising error informing means, and wherein after the touch switch has shifted from the non-sensing state to the sensing state, when touch switch does not return to the non-sensing state within a predetermined time, the display control means causes the error informing means to report this error.

4. The cooking stove according to claim 2, comprising error informing means, and wherein after the touch switch has shifted from the non-sensing state to the sensing state, when touch switch does not return to the non-sensing state within a predetermined time, the display control means causes the error informing means to report this error.

* * * * *